US006959978B2

(12) United States Patent
Chang

(10) Patent No.: US 6,959,978 B2
(45) Date of Patent: Nov. 1, 2005

(54) SENSOR CLEANING APPARATUS FOR INK-JET PRINTER

(75) Inventor: Won-kil Chang, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/615,021

(22) Filed: Jul. 9, 2003

(65) Prior Publication Data

US 2004/0027411 A1 Feb. 12, 2004

(30) Foreign Application Priority Data

Aug. 7, 2002 (KR) ..... 2002-46654

(51) Int. Cl.[7] ..... B41J 2/165; B41J 2/01
(52) U.S. Cl. ..... 347/33; 347/1
(58) Field of Search ..... 347/239, 241, 347/244, 255–256, 258, 1, 22, 29, 30, 32, 33, 81; 348/761; 358/1.4; 399/330

(56) References Cited

U.S. PATENT DOCUMENTS 4,672,457 A * 6/1987 Hyatt ..... 348/761
5,887,236 A * 3/1999 Hirao et al. ..... 399/330
6,585,349 B1 * 7/2003 Lou et al. ..... 347/33
2003/0035123 A1 * 2/2003 Ramanujan et al. ..... 358/1.4

FOREIGN PATENT DOCUMENTS

JP 06238906 A * 8/1994 ..... B41J/02/165

* cited by examiner

*Primary Examiner*—Shih-Wen Hsieh
(74) *Attorney, Agent, or Firm*—Staas & Halsey LLP

(57) ABSTRACT

A sensor cleaning apparatus for an ink-jet printer is capable of preventing a sensing error by wiping scattered ink from a surface of a sensor that is attached to a carriage. The sensor cleaning apparatus has a sensor wiper wiping the surface of the sensor, and a wiper driving portion driving the sensor wiper. As the carriage is moved, and thus the sensor is positioned above the sensor wiper, the sensor wiper is oscillated by the wiper driving portion in a predetermined amplitude, thereby cleaning the surface of the sensor. The sensor wiper oscillates in a perpendicular or parallel direction with respect to an advancing direction of the carriage.

17 Claims, 7 Drawing Sheets

SENSOR CLEANING APPARATUS FOR INK-JET PRINTER

CROSS-REFERENCE TO RELATED APPLICATIONS

This application claims the benefit of Korean Application No. 2002-46654, filed Aug. 7, 2002, in the Korean Intellectual Property Office, the disclosure of which is incorporated herein by reference.

BACKGROUND OF THE INVENTION

1. Field of the Invention

The present invention relates to an ink-jet printer, and more particularly, to a sensor cleaning apparatus for an ink-jet printer that includes a unit cleaning a surface of a sensor, which travels together with the carriage to perform paper size and alignment sensing.

2. Description of the Related Art

Generally, an ink-jet printer is a device for printing data transmitted from a personal computer or the like on a recording medium, such as a sheet of paper. In order to produce high quality printing, it is necessary to sense in real time a printing quality, e.g., inter alia, a width and/or an alignment state of the paper loaded, an actual ink dot print pattern, or the like of the ink-jet printer.

Accordingly, many apparatus and methods have been developed to sense the actual print quality of the ink-jet printer. One of the methods is to install a sensor on one side of a carriage in the ink-jet printer in which the sensor is supposed to sense the actual print quality. Therefore, as the ink-jet printer having the sensor is able to sense in real time the print quality, it can perform continuous printing while automatically adjusting optional printing based on sensed information by the sensor which will hereinafter be referred to as a "carriage mounted sensor".

FIG. 1 is a view of a carriage to and a maintenance station 40 of conventional ink-jet printer having a carriage mounted sensor 30. Referring to FIG. 1, the carriage 10 reciprocates along a shaft (not shown), which extends through a shaft assembling part 11, with respect to a sheet of paper to print texts or images on the paper using an ink cartridge 20 mounted thereon.

The ink cartridge 20, which is mounted on the carriage 10, ejects ink droplets onto the paper (not shown) according to data transmitted from a controlling part (not shown) of the ink-jet printer.

The carriage 10 moves over the paper transversely along a shaft (not shown) inserted into the shaft assembling part 11.

The carriage mounted sensor 30 is installed on one side of the carriage 10 and senses in real time printing quality factors, e.g., inter alia, a paper size, a paper alignment, skews in a dot pattern, or the like.

The maintenance station 40 is located below the carriage 10 and cleans nozzles of an ink jet head of the ink cartridge 20 to prevent the cloggings of the nozzles by dried ink or by any other small particles, e.g., dust, to ensure continued high quality printing.

One or more wiper blades (not shown) are provided in the maintenance station 40 to wipe the nozzles of the ink cartridge 20.

Now, describing a printing process in detail, if the paper is fed into a printing area in the ink-jet printer having the carriage mounted sensor 30, the carriage mounted sensor 30 scans the paper in the printing area optically or using any other sensing method and senses an actual print result, e.g., the dot pattern, a carriage position with respect to a paper edge or the like. Then, the carriage 10 moves right-and-left along the shaft corresponding to the sensed information to perform printing on the paper.

Periodically, the carriage 10 is moved to a service area disposed above the maintenance station 40 in order to clean the nozzles of the ink cartridge 20. When the carriage 10 is placed above the maintenance station 40, the nozzles of the ink cartridge 20 are cleaned by a nozzle wiper 53 mounted on a movable plate 51 of a nozzle wipe assembly 50. The service station 40 may further provide one or more caps to cover the nozzles to prevent the ink in the nozzle openings from being dried.

In the meantime, while most of the ink ejected from the ink cartridge 20 is attached to the paper during the printing process, a small amount of the ink may be scattered to contaminate a surface of the carriage mounted sensor 30. The contamination of the carriage mounted sensor 30 impairs a proper operation of the carriage mounted sensor.

That is, the carriage mounted sensor 30 described above may become non-functional after use of the ink jet printer for a longer period of time. There is thus, a need in the art for an apparatus and/or method to reduce an effect of the sensor surface contamination.

SUMMARY OF THE INVENTION

An aspect of the invention is to solve at least the above and/or other problems and/or disadvantages by providing at least advantages described hereinafter.

Accordingly, it is an aspect of the present invention to provide a sensor cleaning apparatus for ink-jet printer to ensure a normal operation of a carriage mounted sensor by wiping scattered ink from a surface of the carriage mounted sensor.

Additional aspects and advantages of the invention will be set forth in part in the description which follows and, in part, will be obvious from the description, or may be learned by practice of the invention.

The above and/or other aspects of the present invention are accomplished by providing a sensor cleaning apparatus for an ink-jet printer wiping a surface of a sensor attached to a side of a carriage. The sensor cleaning apparatus includes a sensor wiper wiping the surface of the sensor, and a wiper driving portion driving the sensor wiper. As the carriage is moved, and thus the sensor is positioned above the sensor wiper, the sensor wiper is oscillated by the wiper driving portion in a predetermined amplitude, thereby cleaning the surface of the sensor.

According to another aspect of the present invention, the sensor wiper oscillates either in a perpendicular or parallel direction with respect to an advancing direction of the carriage.

The sensor wiper is formed of a rubber material.

The sensor may be moved above the sensor wiper when the ink-jet printer is switched to a maintenance state, or according to a predetermined cycle during a printing process.

The above and/or other aspects of the present invention are also accomplished by a sensor cleaning apparatus for an ink-jet printer wiping a surface of a sensor (carriage mounted sensor) attached to a side of a carriage. The sensor cleaning apparatus includes a movable plate having a nozzle wiper wiping nozzles of an ink cartridge that is mounted on the carriage, and a sensor wiper formed on the movable plate to be in contact with the surface of the sensor when the carriage is positioned above the wiper. While the movable plate is moved and the nozzle wiper wipes the nozzles of the ink cartridge, the sensor wiper wipes the surface of the sensor.

According to another aspect of the present invention, the sensor wiper is moved in either a perpendicular, or parallel direction with respect to an advancing direction of the carriage.

The sensor may be moved above the sensor wiper when the ink-jet printer is switched to a maintenance state, or according to a predetermined cycle during a printing process.

Although the ink may be scattered on the surface of the sensor during an ink ejection process, since the ink is periodically removed, an improper operation of the sensor due to a contaminated surface of the sensor is prevented. Accordingly, the ink-jet printer having the sensor cleaning apparatus according to the present invention maintains a good printing quality.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
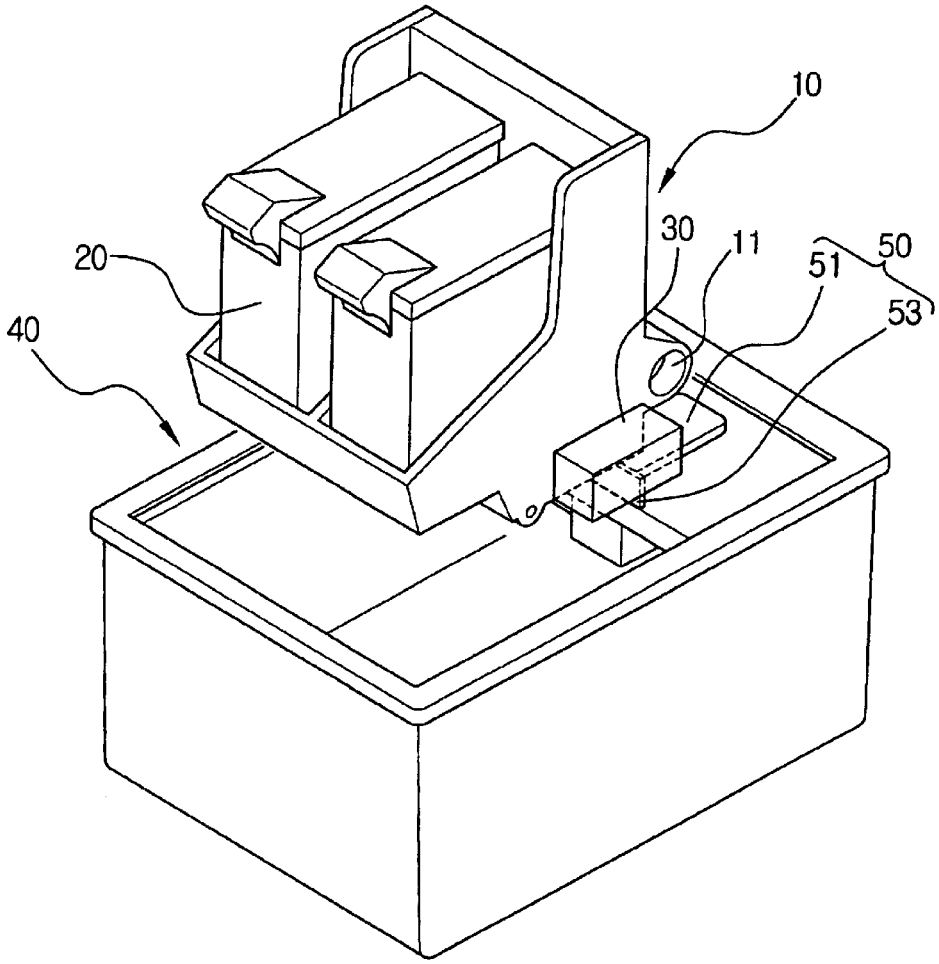
FIG. 1 (PRIOR ART)
FIG. 1 is a perspective view of an ink-jet printer having a conventional automatic paper alignment/width sensor, in which the carriage is positioned above a maintenance station.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

The following detailed description will present a sensor cleaning apparatus of an ink-jet printer according to embodiments of the invention in reference to the accompanying drawings.

Figure 2:
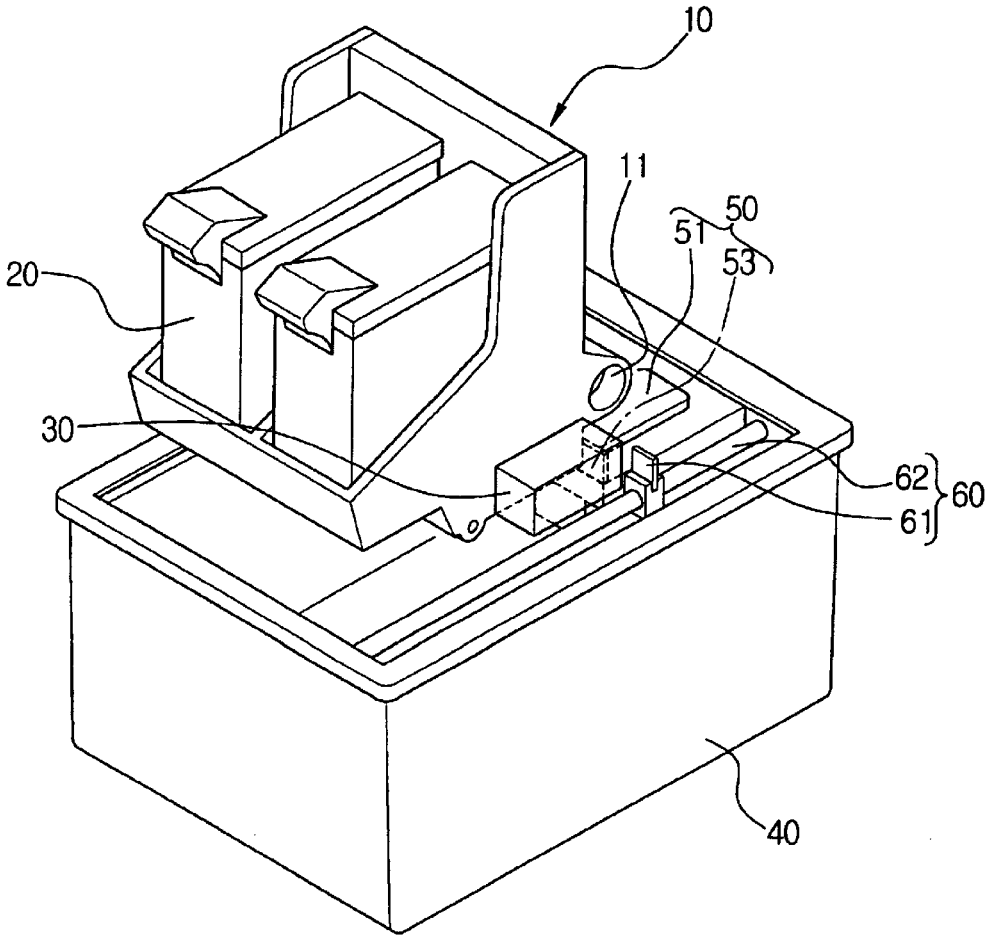
FIG. 2 is a perspective view of a sensor cleaning apparatus for an ink-jet printer according to an embodiment of the present invention.

Referring to FIG. 2, a sensor cleaning apparatus 60 for an ink-jet printer includes a sensor wiper 61 and a wiper driving portion 62.

The sensor wiper 61 is formed on the wiper driving portion 62 so that a free end thereof can be in contact with a surface of a sensing part of a sensor 30 when a carriage 10 is positioned above a maintenance station 40. The sensor 30 is attached to a side of the carriage 10. The sensor wiper 61 is made of a rubber material.

The carriage 10 with an ink cartridge 20 mounted thereon is moved left-and-right with respect to a sheet of paper along a shaft (not shown) assembled in a shaft assembling part 11, thereby performing a printing process. While being mounted on the carriage 10, the ink cartridge 20 ejects ink in accordance with printing data transmitted from a control unit (not shown) of the ink-jet printer. To a side of the carriage 10 is attached the sensor 30. The sensor 30 may sense a size of the paper positioned in a printing area (not shown) of the ink-jet printer, or an alignment state of the paper, or alternatively, the sensor 30 may serve other functions. Any type of a sensor may be employed as the sensor 30 as long as it serves a certain function while moving along with the carriage 10. Also, the sensor 30 may be attached to a left or right side of the carriage 10 depending on a given function. Hereinafter, the sensor 30 that is not specifically defined will be referred to as a carriage mounted sensor 30.

The wiper driving portion 62 is formed at a side of a nozzle wiper assembly 50 of the maintenance station 40 to drive the sensor wiper 61 to oscillate with respect to the surface of the sensor 30 within a predetermined distance. Hereinafter, the surface of the sensor 30 is referred to as a sensing surface that senses an object by emitting light from the sensor 30 and receiving the light from the object. As used herein, the term oscillation refers to linear reciprocating movement of the sensor wiper 61 between two points.

The wiper driving portion 62 may drive the sensor wiper 61 in two directions with respect to an advancing direction of the carriage 10. One of the two directions is to drive the sensor wiper 61 to vertically oscillate with respect to the advancing direction of the carriage 10 to clean nozzles of the ink cartridge 20 while the other one of the two directions is to drive the sensor wiper 61 to oscillate in a parallel direction with respect to the advancing direction of the carriage 10 to clean the nozzles of the ink cartridge 20.

The maintenance station 40 are provided with a nozzle wiper 53 that wipes the nozzles of the ink cartridge 20 mounted on the carriage 10, and a cap (not shown) capping the nozzles so as to prevent the nozzles from being dried. Depending on the number of the ink cartridge 20 mounted on the carriage 10, one or more wipers 53 may be provided.

The nozzle wiper assembly 50 is assembled on an upper side of the maintenance station 40 to clean the nozzles by causing the wiper 53 to oscillate with respect to the nozzles of the ink cartridge 20. The nozzle wiper assembly 50 includes a movable plate 51 moved by a maintenance motor (not sown) and a nozzle wiper 53 formed on an upper surface of the movable plate 51. The nozzle wiper 53 is formed on the movable plate 51 such that a free end of the nozzle wiper 53 contacts the nozzles of the ink cartridge 20 to clean the nozzles when the carriage 10 is positioned above the maintenance station 40. Depending on the number of ink cartridges 20 being mounted on the carriage 10, one or more nozzle wipers 53 may be provided.

While the wiper driving portion 62 may be driven by a separate driving source as described above, it is possible that the wiper driving portion 62 is positioned in a manner such that the wiper driving portion 62 is moved in association with the nozzle wiper assembly 50. With the wiper driving portion 62 being moved in association with the nozzle wiper assembly 50, the surface of the sensor 30 is simultaneously cleaned by the sensor wiper 61 as the nozzles of the ink cartridge 20 are cleaned by the wiper 53. In this case, a wiping direction of the sensor wiper 61 on the surface of the sensor 30 may vary in accordance with the advancing direction of the nozzle wiper assembly 50. That is, in the case that the nozzles of the ink cartridge 20 are cleaned with the nozzle wiper assembly 50 moving in a perpendicular direction with respect to the advancing direction of the carriage 10, the sensor wiper 61 cleans the surface of the sensor 30 in a perpendicular oscillation movement with respect to the carriage 10. In the case that the nozzles are cleaned by the nozzle wiper assembly 50 moving in a parallel direction with respect to the advancing direction of the carriage 10, the sensor wiper 61 cleans the surface of the sensor 30 in a parallel movement with respect to the advancing direction of the carriage 10.

Figure 3:
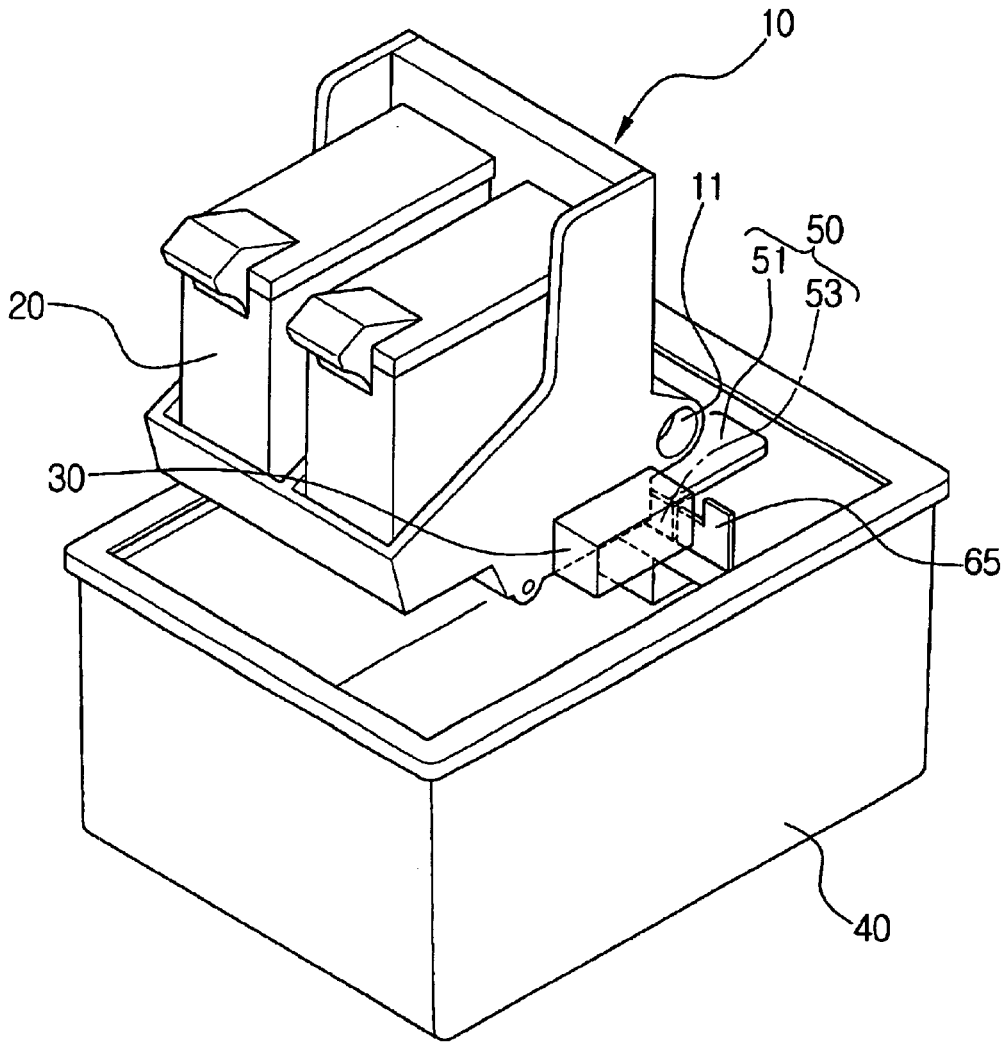
FIG. 3 is a perspective view of a sensor cleaning apparatus for an ink-jet printer according to another embodiment of the present invention.

FIG. 3 shows a sensor cleaning apparatus according to another embodiment of the present invention, in which a sensor wiper 65 wiping the carriage mounted sensor 30 is formed on the movable plate 51 of the nozzle wiper assembly 50.

In other words, the sensor wiper 65 is formed on a certain portion of the movable plate 51 so that the sensor wiper 65 can face the sensor 30 attached to one side of the carriage 10 when the carriage 10 is positioned on the maintenance station 40. It is possible that the sensor wiper 65 is formed in an appropriate length that allows a free end of the sensor wiper 65 to contact the surface of the sensor 30 so as to wipe the ink from the surface of the sensor 30. Accordingly, as the nozzles of the ink cartridge 20 mounted on the carriage 10 are cleaned by the wiper 53 formed on the movable plate 51 in a forward and backward oscillating motion, the surface of the sensor 30 is also wiped by the sensor wiper 65. Although it is depicted in FIG. 3 that the movable plate 51 oscillates in the perpendicular direction with respect to the advancing direction of the carriage 10 by way of an example, it is of course possible that the movable plate 51 may move in the parallel direction with respect to the advancing direction of the carriage 10. In this case, the sensor wiper 65 cleans the surface of the sensor 30 in an oscillating movement parallel to the advancing direction of the carriage 10.

Figure 4:
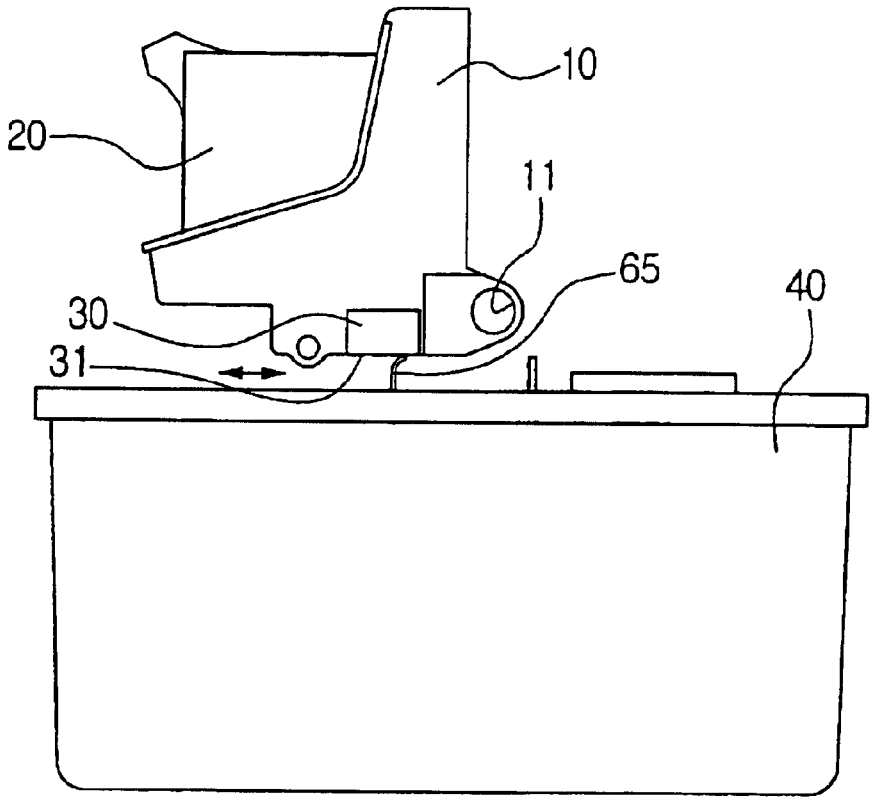
FIG. 4 is a view showing a state that the sensor cleaning apparatus of FIG. 3 wipes a surface of a carriage mounted sensor.

An operation of the sensor cleaning apparatus for ink-jet printer according to the present invention will be described below with reference to the accompanying FIGS. 2 to 4.

As the carriage 10 is positioned above the maintenance station 40, the movable plate 51 is oscillated in a predetermined amplitude in the perpendicular direction, i.e., a forward or backward direction, with respect to a shaft (not shown) that is assembled in the shaft assembling part 11. Accordingly, the nozzles of the ink cartridge 20 are wiped by the wiper 53 which is formed on the upper surface of the movable plate 51. At this time, the wiper driving portion 62 is also moved with the sensor wiper 61 likewise oscillating forward and backward directions. Accordingly, a sensor surface 31 of the sensor 30, which is positioned above the sensor wiper 65, is wiped by the sensor wiper 61 in an oscillating movement of the sensor wiper 61, and the ink that was attached thereto during the printing is removed.

In a case that the wiper driving portion 62 is formed to move in association with the movable plate 51, or the sensor wiper 65 is formed on the movable plate 51, with a movement of the movable plate 51 in the perpendicular direction with respect to the advancing direction of the carriage 10, the sensor wiper 62 and the nozzle wiper 53 are simultaneously moved to clean both the sensor surface 31 of the sensor 30 and the nozzles of the ink cartridge 20. The relationship between the sensor wiper 65 and the sensor surface 31 of the sensor 30 is illustrated in FIG. 4. Since the movable plate 51 is oscillated by an amplitude (distance) that is sufficient to wipe the nozzles of the ink cartridge 20 mounted on the carriage 10, the sensor surface of the sensor 30 is sufficiently cleaned.

Usually, the carriage 10 is moved above the maintenance station 40 when the ink-jet printer has switched to the maintenance state. When the ink-jet printer is in the maintenance state, such as an initial maintenance motion, the carriage 10 is moved above the maintenance station 40, and the nozzles of the ink cartridge 20 and the sensor surface 31 of the sensor 30 are wiped by the nozzle wiper 53 and the sensor wiper 61, 65, respectively, both in the oscillating motion.

It is possible that a higher printing quality is set when the carriage 10 automatically moves to above the maintenance station 40 when the number of printed pages exceeds a predetermined value. By doing so, the scattered ink is completely removed from the nozzles of the ink cartridge 20 of the carriage 10 and from the sensor surface 31 of the carriage mounted sensor 30 periodically by the wiper 53 and the sensor wiper 61, 65, respectively, in the oscillating motion.

The operation of the sensor cleaning apparatus according to the present invention during a printing operation of the ink-jet printer will be described below.

If a paper (not shown) is fed into a printing area in the ink-jet printer having the sensor 30, the sensor 30 scans the paper in the printing area optically or any other sensing methods and senses an actual print result, e.g., a dot pattern, a carriage position with respect to a paper edge or the like. Then, the carriage 10 moves right-and-left along the shaft corresponding to sensed information to perform printing on the paper. During an ink ejection from the ink cartridge 20, some ink may be scattered to areas other than the paper, such as another neighboring ink cartridge 20 or the sensor surface 31 of the carriage mounted sensor 30.

Figure 5:
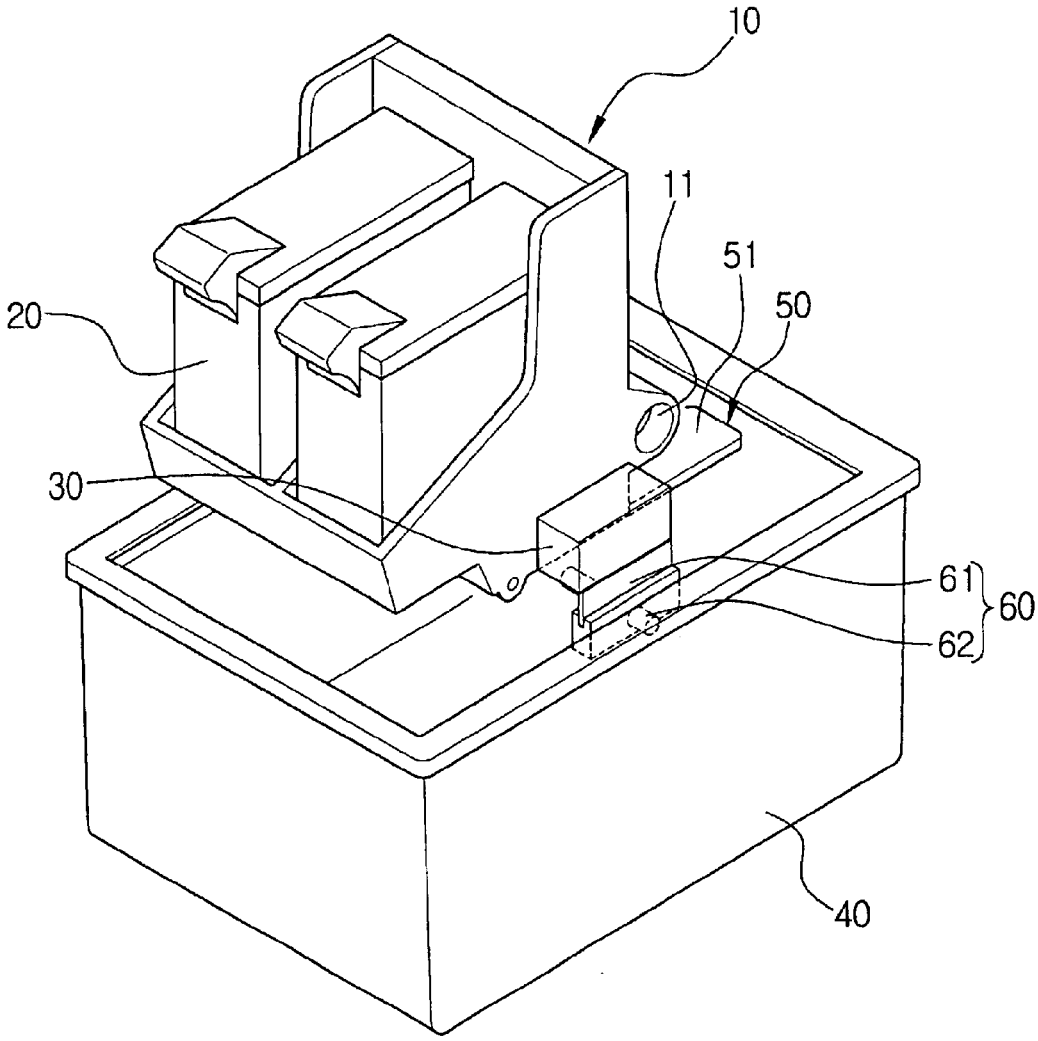
FIGS. 5–7 are perspective views of the sensor cleaning apparatus of FIG. 3 showing the oscillating movement thereof.
Figure 6:
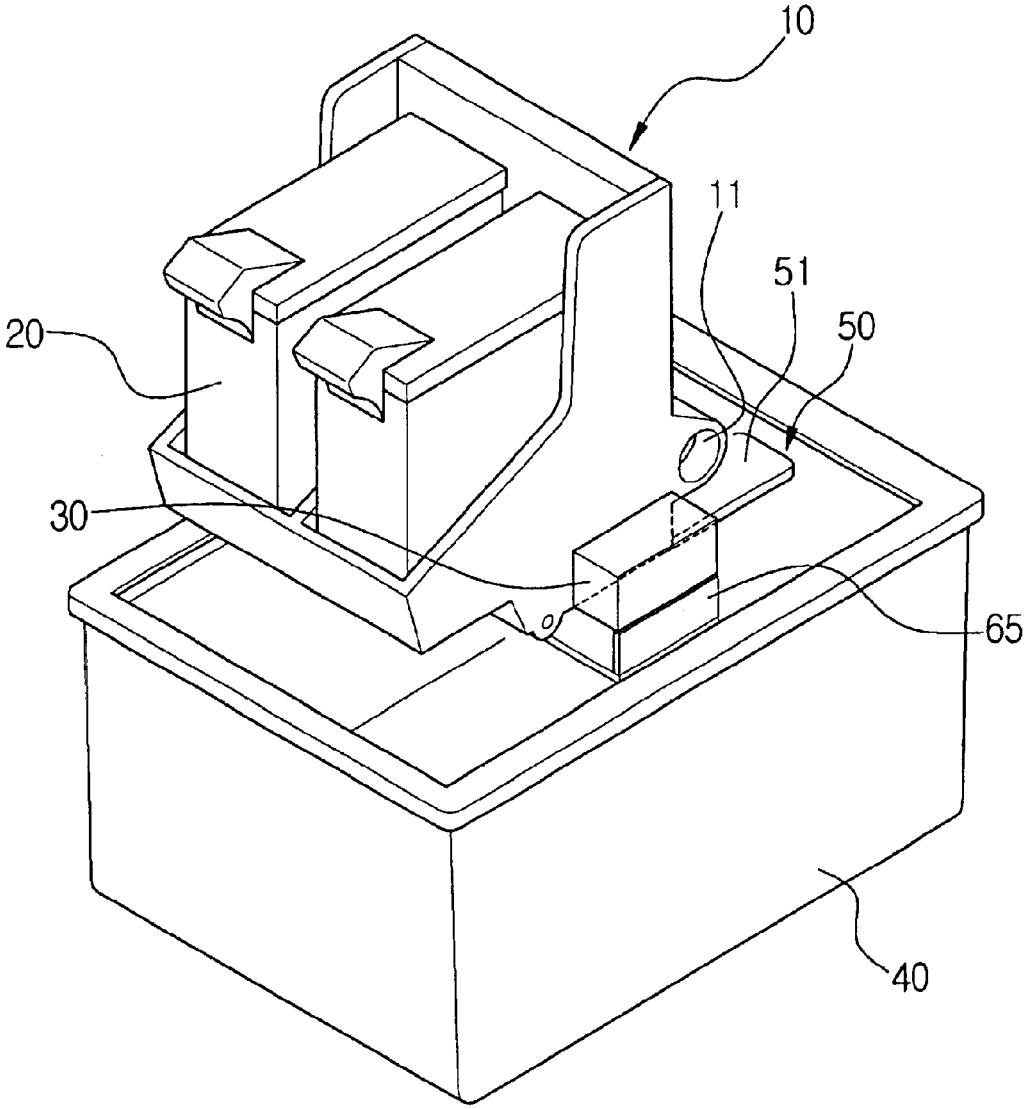
Figure 7:
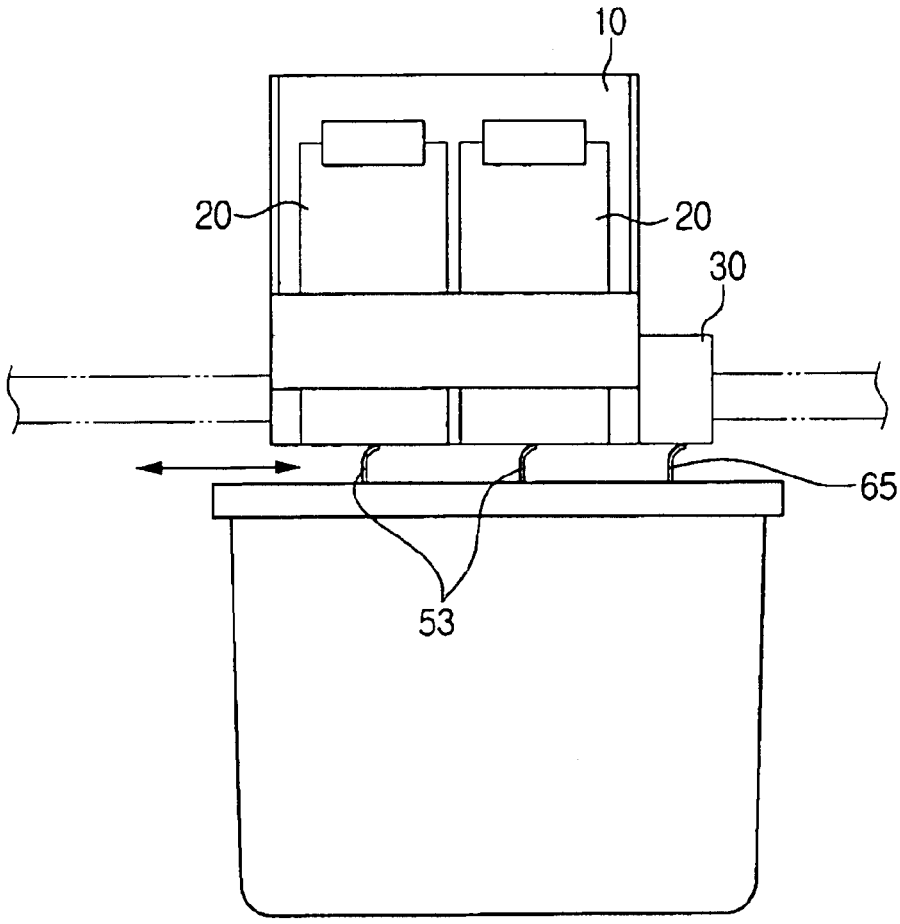

Periodically, the control unit (not shown) of the ink-jet printer controls the carriage 10 to move above the maintenance station 40 in order to maintain the predetermined printing quality. With the carriage 10 being placed above the maintenance station 40, the nozzle wiper assembly 50 oscillates forward and backward, wiping the scattered ink from the nozzles of the ink cartridge 20 and the sensor surface 31 of the sensor 30. After a wiping operation, the carriage 10 is returned to the printing area and resumes printing. As illustrated in FIGS. 5–7, the carriage and the sensor wiper move parallel to each other.

With the completion of the printing, the nozzles of the ink cartridge 20 and the sensor surface 31 of the carriage mounted sensor 30 are cleaned by the processes as described above, and then the nozzles of the ink cartridge 20 are capped by the cap (not shown) provided at the maintenance station 40 so that the ink of the ink cartridge 20 is prevented from drying.

Although the ink may be scattered on the surface of the carriage mounted sensor during ink ejection process, since the scattered ink is periodically removed, any inaccurate operation of the sensor due to a contaminated surface of the sensor is prevented.

The foregoing embodiments and advantages are merely exemplary and are not to be construed as limiting the present invention. The present teaching can be readily applied to other types of apparatuses. The description of the present invention is intended to be illustrative, and not to limit the scope of the claims.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A sensor cleaning apparatus for an ink-jet printer having a sensor attached to a side of a carriage, comprising:

a sensor wiper which wipes a surface of the sensor; and a wiper driving portion which drives the sensor wiper, wherein the sensor is positioned above the sensor wiper according to a movement of the carriage, the sensor wiper is oscillated by the wiper driving portion by a predetermined amplitude to clean the surface of the sensor, and the sensor wiper is formed separately from a nozzle wiper.

2. The sensor cleaning apparatus of claim 1, wherein the sensor wiper oscillates in a perpendicular direction with respect to an advancing direction of the carriage.

3. The sensor cleaning apparatus of claim 1, wherein the sensor wiper oscillates in a parallel direction with respect to an advancing direction of the carriage.

4. The sensor cleaning apparatus of claim 1, wherein the sensor wiper is formed of a rubber material.

5. The sensor cleaning apparatus of claim 1, wherein the sensor is moved above the sensor wiper when the ink-jet printer is switched to a maintenance state.

6. The sensor cleaning apparatus of claim 1, wherein the sensor is periodically moved above the sensor wiper during a printing process.

7. A sensor cleaning apparatus for an ink-jet printer having a sensor attached to a side of a carriage having an ink cartridge with nozzles, comprising:

a movable plate having a nozzle wiper wiping the nozzles of the ink cartridge that is mounted on the carriage; and a sensor wiper formed on the movable plate to be in contact with a surface of the sensor when the carriage is positioned above the nozzle wiper, wherein while the movable plate is moved and the nozzle wiper wipes the nozzles of the ink cartridge, the sensor wiper wipes the surface of the sensor.

8. The sensor cleaning apparatus of claim 7, wherein the wiper is moved in a perpendicular direction with respect to an advancing direction of the carriage.

9. The sensor cleaning apparatus of claim 7, wherein the wiper is moved in a parallel direction with respect to an advancing direction of the carriage.

10. The sensor cleaning apparatus of claim 7, wherein the sensor wiper is formed of a rubber material.

11. The sensor cleaning apparatus of claim 7, wherein the sensor is moved above the sensor wiper when the ink-jet printer is switched to a maintenance state.

12. The sensor cleaning apparatus of claim 7, wherein the sensor is periodically moved to above the sensor wiper during a printing process.

13. An ink-jet printer having a sensor attached to a side of a carriage having an ink cartridge with nozzles, comprising:

a sensor cleaning apparatus comprising, a movable plate having a nozzle wiper mounted thereon to wipe the nozzles of the ink cartridge that is mounted on the carriage, and a sensor wiper formed on the movable plate to be in contact with a surface of the sensor when the carriage is positioned above the nozzle wiper, wherein while the movable plate is moved and the nozzle wiper wipes the nozzles of the ink cartridge, the sensor wiper wipes the surface of the sensor.

14. The ink-jet printer of claim 13, wherein the sensor is moved above the sensor wiper when the ink-jet printer is switched to a maintenance state.

15. The sensor cleaning apparatus of claim 13, wherein the sensor is periodically moved above the sensor wiper during a printing process.

16. A method in a sensor cleaning apparatus for an ink-jet printer having a sensor attached to a side of a carriage, the method comprising:

wiping a surface of the sensor using a sensor wiper; and driving the sensor wiper using a wiper driving portion, wherein the sensor is positioned above the sensor wiper according to a movement of the carriage, the sensor wiper is oscillated by the wiper driving portion by a predetermined amplitude to clean the surface of the sensor, and the sensor wiper is formed separately from a nozzle wiper.

17. A method in a sensor cleaning apparatus for an ink-jet printer having a sensor attached to a side of a carriage having an ink cartridge with nozzles, the method comprising:

wiping the nozzles of the ink cartridge that is mounted on the carriage, using a movable plate having a nozzle wiper; and causing a sensor wiper formed on the movable plate to be in contact with a surface of the sensor when the carriage is positioned above the nozzle wiper, wherein while the movable plate is moved and the nozzle wiper wipes the nozzles of the ink cartridge, the sensor wiper wipes the surface of the sensor.

* * * * *